US011427955B2

(12) United States Patent
Park

(10) Patent No.: US 11,427,955 B2
(45) Date of Patent: Aug. 30, 2022

(54) METHOD, DEVICE AND SYSTEM OF CONTROLLING CLOTHING TREATING COURSES ACCORDING TO CLOTHING MATERIALS

(71) Applicant: LG ELECTRONICS INC., Seoul (KR)

(72) Inventor: Yun Sik Park, Seoul (KR)

(73) Assignee: LG Electronics Inc., Seoul (KR)

( * ) Notice: Subject to any disclaimer, the term of this patent is extended or adjusted under 35 U.S.C. 154(b) by 79 days.

(21) Appl. No.: 16/599,631

(22) Filed: Oct. 11, 2019

(65) Prior Publication Data

US 2020/0040508 A1 Feb. 6, 2020

(30) Foreign Application Priority Data

Aug. 30, 2019 (KR) ..... 10-2019-0107642

(51) Int. Cl.
*D06F 34/08* (2020.01)
*D06F 73/02* (2006.01)
(Continued)

(52) U.S. Cl.
CPC ..... *D06F 73/02* (2013.01); *D06F 34/08* (2020.02); *D06F 58/10* (2013.01);
(Continued)

(58) Field of Classification Search
None
See application file for complete search history.

(56) References Cited

U.S. PATENT DOCUMENTS 5,897,672 A * 4/1999 Badami ..... D06F 34/18 8/159
2010/0278441 A1* 11/2010 Shashidhar ..... G01N 21/359 382/218

(Continued)

FOREIGN PATENT DOCUMENTS

KR 1020130135016 12/2013

OTHER PUBLICATIONS

Espacenet translation KR20130135016A an Apparatus and a Method for Recognizing Material of the Objects (Year: 2013).*

*Primary Examiner* — Cristi J Tate-Sims
(74) *Attorney, Agent, or Firm* — Fish & Richardson P.C.

(57) ABSTRACT

The present disclosure discloses a clothing course control system including a clothing treating course controller according to a clothing material and a server. The clothing treating course controller includes a hanger, a motor configured to vibrate the hanger, a motor current sensor configured to sense a motor current pattern, a clothing material classifier configured to classify a clothing material based on the motor current pattern, and a course controller configured to execute a clothing treating course according to the classified clothing material, the server includes an artificial intelligence model learner configured to generate a clothing material classifying engine trained with data related to the received motor current pattern through an artificial neural network. According to the present disclosure, a clothing treating course of a clothing treating device may be controlled using an artificial intelligence (AI) based clothing material classifying technique and a 5G network.

8 Claims, 10 Drawing Sheets

(51) Int. Cl.

| | |
|---|---|
| *D06F 103/04* | (2020.01) |
| *D06F 103/06* | (2020.01) |
| *D06F 103/44* | (2020.01) |
| *D06F 105/00* | (2020.01) |
| *D06F 105/52* | (2020.01) |
| *D06F 58/10* | (2006.01) |

(52) U.S. Cl.
CPC ..... *D06F 2103/04* (2020.02); *D06F 2103/06* (2020.02); *D06F 2103/44* (2020.02); *D06F 2105/00* (2020.02); *D06F 2105/52* (2020.02)

(56) References Cited

U.S. PATENT DOCUMENTS

| | | | | |
|---|---|---|---|---|
| 2013/0086830 | A1* | 4/2013 | Moon | D06F 73/02 38/1 A |
| 2014/0189959 | A1* | 7/2014 | Dokonal | D06F 35/006 8/137 |
| 2017/0350066 | A1* | 12/2017 | Kim | D06F 58/30 |
| 2018/0066389 | A1* | 3/2018 | Wu | D06F 58/30 |

* cited by examiner

METHOD, DEVICE AND SYSTEM OF CONTROLLING CLOTHING TREATING COURSES ACCORDING TO CLOTHING MATERIALS

CROSS-REFERENCE TO RELATED APPLICATION

This present application claims benefit of priority to Korean Patent Application No. 10-2019-0107642, entitled "METHOD, DEVICE AND SYSTEM OF CONTROLLING CLOTHING TREATING COURSES ACCORDING TO CLOTHING MATERIALS," filed on Aug. 30, 2019, in the Korean Intellectual Property Office, the entire disclosure of which is incorporated herein by reference.

BACKGROUND

1. Technical Field

The present disclosure relates to a method, a device, and a system of controlling execution of clothing treating courses according to clothing materials, and more particularly, to a method, a device, and a system of controlling execution of clothing treating courses according to clothing materials based on a sensor or artificial intelligence.

2. Description of the Related Art

In the related art, when a clothing treating device such as a washing machine, a clothing care system, and a drying machine is used, a user needs to manually select a clothing treating course. Therefore, the user cannot recognize clothing which needs a special care such as wool or fur in advance, so that a fabric may be damaged.

In the related art, a clothing material recognizing device of a subject includes an image camera which photographs a space image including various subjects present in a space, an exploring radar which irradiates an incident wave to the objects to receive space radar information including a surface reflection wave of each surface of the subjects and an internal reflection wave returning from the insides of the subjects, an information storage which stores reference physical property information corresponding to the clothing materials of the subjects, and a clothing material recognizer which recognizes clothing material information of the subjects using the reference physical property information of the information storage, the space image provided from the image camera, and the space radar information provided from the exploring radar. However, the device identifies the material information with the reflection wave information of the exploring radar and infers position information of the image with the image information so that since the material information can be identified only when the reflection wave information of the radar is provided, it is difficult to identify the material only with the image information.

Further, when execution of the clothing treating course is controlled by recognizing the clothing based on the vision sensor, it is difficult to identify a property of the clothing material by learning and recognizing a shape element of the clothing. The vision sensor needs to capture light so that in a closed space where there is no light, a light device is necessary. Further, it is difficult to ensure a generalized performance for various clothing by the vision sensor.

SUMMARY OF THE INVENTION

An embodiment of the present disclosure is to minimize a damage of the clothing by estimating clothing materials without intervention of the user because when the clothing treating device is used, the user manually manipulates the product so that the user cannot recognize clothing which needs a special care in advance, which may cause a damage of the clothing.

An embodiment of the present disclosure is to provide a clothing material matching technique which allows a clothing treating device to effectively perform a special clothing function which has been already provided to create a smart clothing treating device.

An embodiment of the present disclosure is to allow a clothing treating device interconnected with motor current pattern information to perform various functions.

The present disclosure is not limited to what has been described above, and other aspects and advantages of the present disclosure will be understood by the following description and become apparent from the embodiments of the present disclosure. Furthermore, it will be understood that aspects and advantages of the present disclosure may be achieved by the means set forth in claims and combinations thereof.

In order to achieve the above-described object, a method, a device, a system of identifying a fabric according to an embodiment of the present disclosure classify materials of the clothing to automatically execute a clothing treating course of a clothing treating device, based AI technology.

Specifically, according to an aspect of the present disclosure, a method of controlling to execute a clothing treating course according to a clothing material includes sensing a weight of a clothing hung on a hanger; sensing a motor current pattern which is reflected to a motor in accordance with a weight of the clothing when the hanger is vibrated; classifying a clothing material based on the motor current pattern; and controlling to automatically execute a clothing treating course according to the classified clothing material.

According to an aspect of the present invention, a device of controlling a clothing treating course according to a clothing material includes a weight sensor configured to sense a weight of a clothing hung on a hanger, a motor configured to vibrate the hanger, a motor current sensor configured to sense a motor current pattern which is reflected to a motor in accordance with a weight of the clothing when the motor operates; a clothing material classifier configured to classify a clothing material based on the motor current pattern, and a course controller configured to control the clothing treating course according to the classified clothing material.

According to another aspect of the present disclosure, a clothing course control system includes a clothing treating course controller according to a clothing material and a server, the clothing treating course controller includes: a hanger on which a clothing is hung, a weight sensor configured to sense a weight of a clothing hung on a hanger, a motor configured to vibrate the hanger, a motor current sensor configured to sense a motor current pattern which is reflected to a motor in accordance with a weight of the clothing when the motor operates, a clothing material classifier configured to classify a clothing material based on the motor current pattern, and a course controller configured to automatically control the clothing treating course according to the classified clothing material, the server includes an artificial intelligence model learner configured to generate a clothing material classifying engine trained with label data obtained by matching a label related to the received motor current pattern through an artificial neural network, the server is configured to transmit the clothing material classifying engine trained through the artificial intelligence model learner to the clothing treating course controller, the clothing material classifier is configured to classify a material of the clothing through the trained clothing material classifying engine transmitted from the server, and a communicator is configured to transmit information about the material of the clothing classified by the clothing material classifier to a clothing appliance.

According to the embodiment of the present disclosure, it is possible to provide clothing material information to a user using artificial intelligence (AI), an artificial intelligence based screen recognizing technique, and a 5G network.

According to the embodiment of the present disclosure, user's convenience and usage reliability can be provided by providing a function of issuing a notification to a user for a clothing which needs a special care because when the clothing is washed or dried by a clothing appliance, the clothing is damaged.

According to the embodiment of the present disclosure, the clothing appliance receives clothing material information so that the clothing appliance may provide an optimal clothing treating course without intervention of the user.

According to the embodiment of the present disclosure, clothing material information which is possessed by the user is recorded through a data storage device such as a cloud server and is utilized for a product to identify a user's preference function and provide an optimal clothing treating course by the clothing treating device.

According to the embodiment of the present disclosure, a course set by a user and a motor current pattern is learned and registered to optimize a performance of a clothing treating device for every home.

The effects of the present disclosure are not limited to the effects mentioned above, and other effects not mentioned may be clearly understood by those skilled in the art from the following description.

BRIEF DESCRIPTION OF THE DRAWINGS

The above and other aspects, features, and advantages of the present disclosure will become apparent from the detailed description of the following aspects in conjunction with the accompanying drawings, in which.

DETAILED DESCRIPTION

Figure 1:
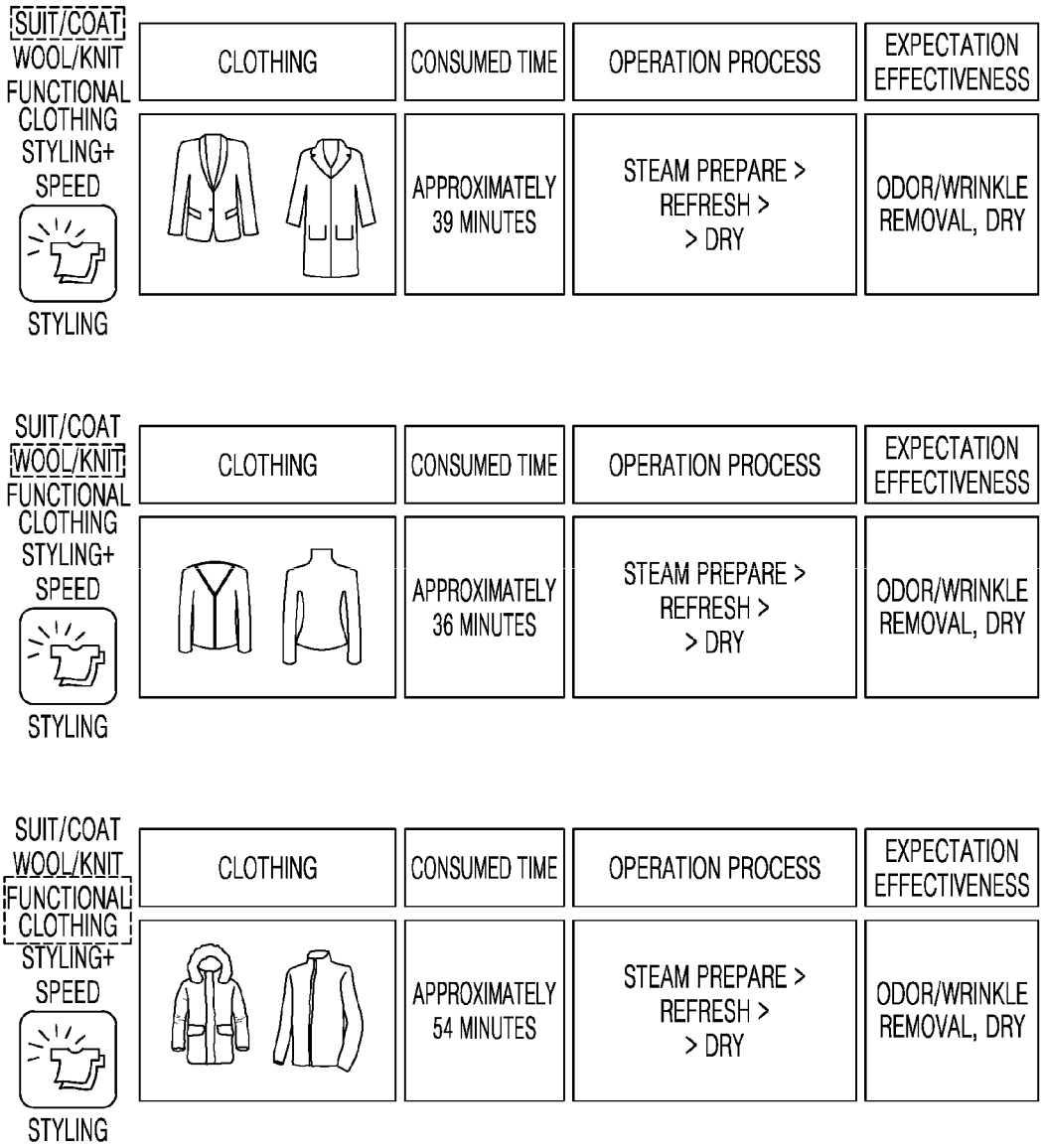
FIG. 1 is an example of clothing treating courses of a clothing treating device according to an embodiment of the present disclosure.

Advantages and features of the present disclosure and methods for achieving them will become apparent from the descriptions of aspects hereinbelow with reference to the accompanying drawings. However, the description of particular example embodiments is not intended to limit the present disclosure to the particular example embodiments disclosed herein, but on the contrary, it should be understood that the present disclosure is to cover all modifications, equivalents and alternatives falling within the spirit and scope of the present disclosure. The example embodiments disclosed below are provided so that the present disclosure will be thorough and complete, and also to provide a more complete understanding of the scope of the present disclosure to those of ordinary skill in the art. In the interest of clarity, not all details of the relevant art are described in detail in the present specification in so much as such details are not necessary to obtain a complete understanding of the present disclosure.

The terminology used herein is used for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "includes," "including," "containing," "has," "having" or other variations thereof are inclusive and therefore specify the presence of stated features, integers, steps, operations, elements, and/or components, but do not preclude the presence or addition of one or more other features, integers, steps, operations, elements, components, and/or groups thereof. Furthermore, these terms such as "first," "second," and other numerical terms, are used only to distinguish one element from another element. These terms are generally only used to distinguish one element from another.

Hereinafter, embodiments of the present disclosure will be described in detail with reference to the accompanying drawings. Like reference numerals designate like elements throughout the specification, and overlapping descriptions of the elements will not be provided.

FIG. 1 is an example of clothing treating courses of a clothing treating device according to an embodiment of the present disclosure.

The clothing treating course of the clothing treating device may include a suit/coat course, a wool/knit course, and a functional clothing course. Further, the clothing treating course may include functional courses such as a styling+ course for odor removal or wrinkle removal, a speed course focused on a quick deodorizing function, a sanitizing course, or a fine dust course.

For every course, a consumed time and an operating process may vary depending on a kind and a material of clothing and all the courses have an expectation effectiveness of removing order/wrinkle and drying. It takes approximately 39 minutes for the suit/coat course to perform steam preparing, refreshing, and drying sequences. It takes approximately 36 minutes for the wool/knit course to perform steam preparing, refreshing, and drying sequences. It takes approximately 54 minutes for the functional clothing course to perform steam preparing, refreshing, and drying sequences. The functional clothing may include a sportswear and a mountain-climbing clothing. The styling+ course is a course for better odor removal and wrinkle removal and it takes approximately 67 minutes to perform steam preparing, refreshing, and drying sequences. The speed course is simply a course focused on a deodorizing performance and it takes approximately 67 minutes to perform steam preparing, refreshing, and drying sequences. The clothing treating course of the clothing treating device is not limited thereto and various courses may be performed depending on a material, an amount of materials, and a purpose of the clothing.

In another embodiment, if the clothing treating device is a washing machine or a drying machine, the clothing treating course suitable for the washing machine or the drying machine may be performed according to a clothing material.

The clothing treating course of the clothing treating device may be automatically executed by a method, a device, and a system which control to execute the clothing treating course according to the clothing material of the present disclosure which will be described below.

Figure 2:
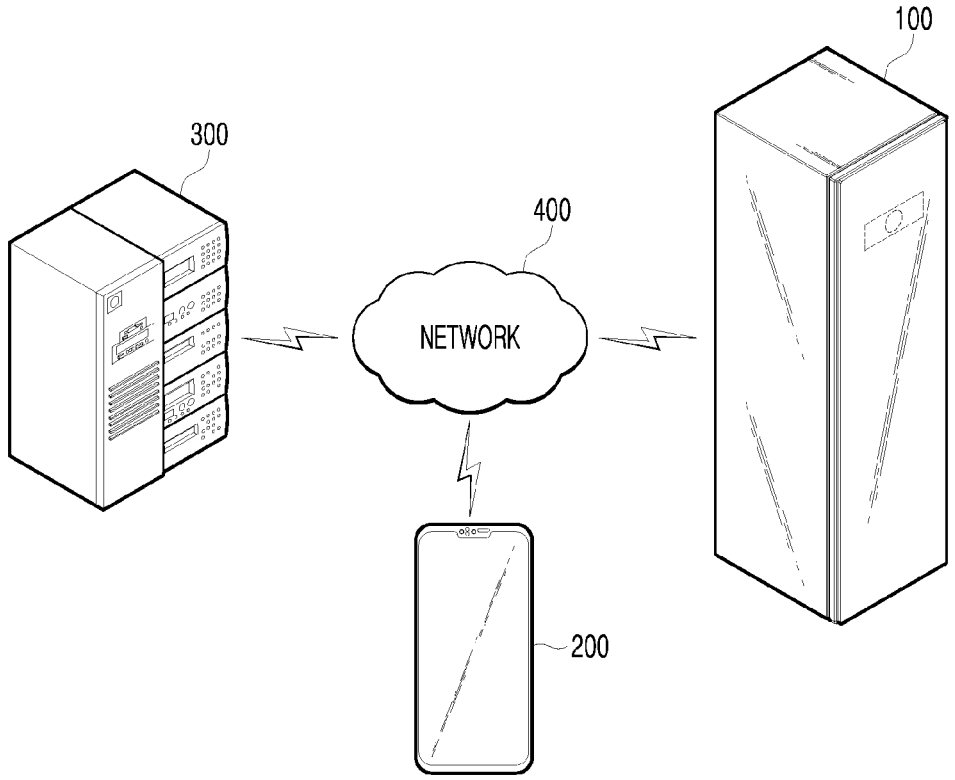
FIG. 2 is an exemplary diagram of a system environment including a clothing treating device, a user terminal, a server, and a network which communicably connects the above components.

FIG. 2 is an exemplary diagram of a system environment including a clothing treating device, a user terminal, a server, and a network which communicably connects the above components.

The clothing treating device 100 controls the clothing treating course to be executed using big data, an artificial intelligence (AI) algorithm and/or a machine learning algorithm in the 5G environment connected for Internet of Things.

Referring to FIG. 2, a clothing treating course executing control environment 1 may include a clothing treating device 100, a user terminal 200, a server 300, and a network 400. The user terminal 200 may receive matters regarding a setting and an operation of the clothing treating device 100 and transmit the clothing treating course and various operation control signals to the clothing treating device 100.

In the embodiment of the present disclosure, the clothing treating device 100 may communicate with the user terminal 200 and the server 300 through the network 400 and perform machine learning such as deep learning. In the memory 132, data used for the machine learning and result data may be stored.

The server 300 may be a database server that provides big data required for applying various artificial intelligence algorithms, and data used for operating the clothing treatment apparatus 100. In addition, the server 300 may include a web server or an application server which remotely controls an operation of the clothing treating device 100 using a clothing treating course application or a clothing treating course executing control web browser installed in the user terminal.

Artificial intelligence (AI) is an area of computer engineering science and information technology that studies methods to make computers mimic intelligent human behaviors such as reasoning, learning, self-improving, and the like.

In addition, the artificial intelligence does not exist on its own, but is rather directly or indirectly related to a number of other fields in computer science. In recent years, there have been numerous attempts to introduce an element of AI into various fields of information technology to solve problems in the respective fields.

Machine learning is an area of artificial intelligence that includes the field of study that gives computers the capability to learn without being explicitly programmed. More specifically, machine learning is a technology that investigates and builds systems, and algorithms for such systems, which are capable of learning, making predictions, and enhancing their own performance on the basis of experiential data. Machine learning algorithms, rather than executing rigidly-set static program commands, may take an approach that builds a specific model based on input data for deriving a prediction or decision.

The network 400 may perform a role of connecting the clothing treatment apparatus 100, the user terminal 200, and the server 300. The network 400 may include a wired network, such as a local area network (LAN), a wide area network (WAN), a metropolitan area network (MAN), or an integrated service digital network (ISDN), or a wireless network, such as a wireless LAN, CDMA, Bluetooth, or satellite communication; however, the present disclosure is not limited thereto. In addition, the network 400 may transmit and receive information using short distance communication and/or long distance communication. Here, the short distance communication may include Bluetooth, radio frequency identification (RFID), infrared data association (IrDA), ultra-wideband (UWB), ZigBee, or wireless fidelity (Wi-Fi) technology, and the long distance communication may include code division multiple access (CDMA), frequency division multiple access (FDMA), time division multiple access (TDMA), orthogonal frequency division multiple access (OFDMA), or single carrier frequency division multiple access (SC-FDMA) technology.

The network 400 may include a connection of network elements such as a hub, a bridge, a router, a switch, and a gateway. The network 400 can include one or more connected networks, for example, a multi-network environment, including a public network such as an internet and a private network such as a safe corporate private network. The access to the network 400 can be provided via one or more wired or wireless access networks. Further, the network 400 may support 5G communication and/or an Internet of things (IoT) network for exchanging and processing information between distributed components such as objects.

Figure 3:
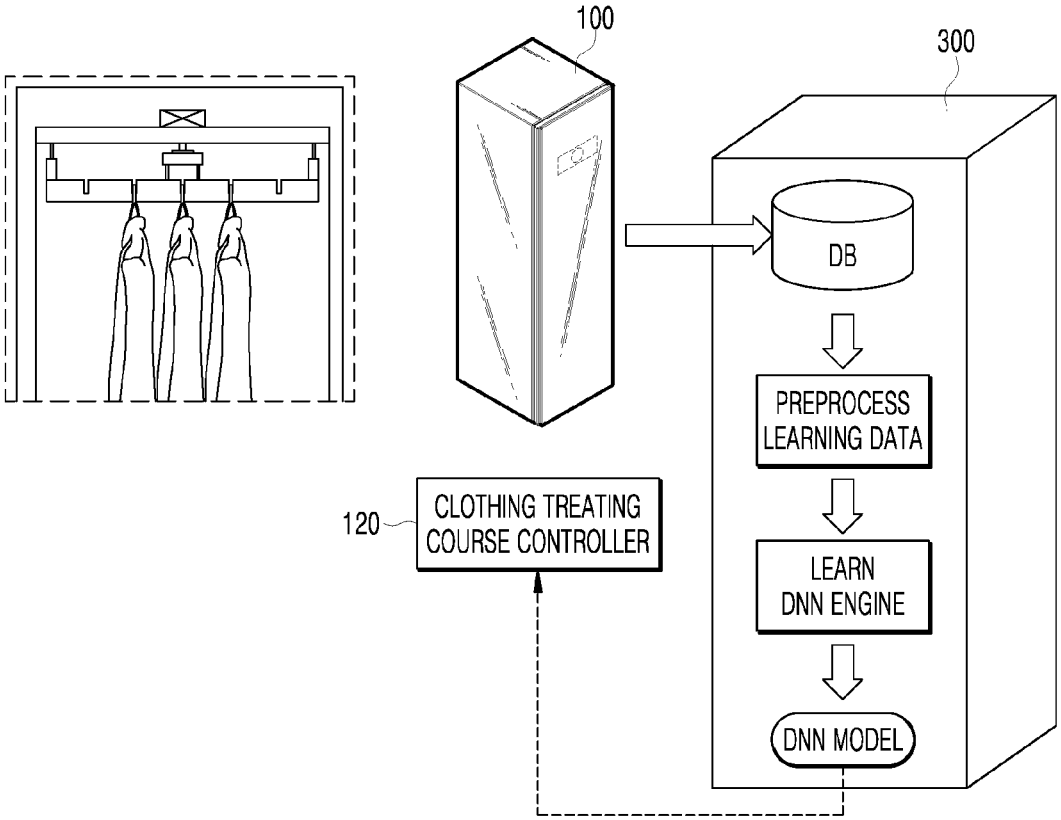
FIG. 3 is an exemplary diagram of a clothing treating system including a clothing treating device including a clothing treating course controller and a server.

FIG. 3 is an exemplary diagram of a clothing treating system including a clothing treating device including a clothing treating course controller and a server.

In the clothing treating device 100 and the server 300, an artificial neural network may be loaded. Further, the clothing treating device 100 may transmit material information of the clothing identified through the trained artificial intelligence model to one or more user terminals 200 searched in accordance with an operation mode.

The clothing treating device 100 may use the server 300 to train the artificial intelligence model which infers (or identifies) a kind and a material of the clothing. For example, the clothing treating device 100 includes an artificial intelligence model learner 124 to generate and use the trained artificial intelligence model to classify the material of the clothing by itself. However, the server 300 may include the artificial intelligence model learner or big data collected by the server 300 may be used instead.

The clothing treating device 100 may use various programs related to the artificial intelligence algorithm which is stored in a memory which is a local area or stored in the server 300. That is, the server 300 serves to collect data and train the artificial intelligence model using the collected data. The clothing treating device 100 may classify the kind or the material of the clothing based on the generated artificial intelligence model.

The server 300 may receive data related to a motor current pattern indicating a load characteristic which is reflected to the motor depending on a weight and a kind of the clothing from the clothing treating device 100 and receive image information of a color, a pattern, or an outline of a specific portion of the clothing, tag related data, and data related to a fabric structure of the specific portion. The server 300 may provide training data required to identify the material of the clothing and various programs related to the artificial intelligence algorithm such as API or a workflow to the user terminal using the artificial intelligence algorithm. That is, the server 300 trains the artificial intelligence model using training data including a motor current pattern and label data obtained by matching a label of the clothing material to data related to the motor current pattern to classify the kind or the material of the clothing. Further, the server 300 may train the artificial intelligence model using training data including one or more data of image information of a color, a pattern, or an outline of a specific portion of the clothing, tag related information of the clothing, millimeter wave information, and near infrared wavelength information and data related to the material of the clothing. In addition, the server 300 may evaluate the artificial intelligence model and update the artificial intelligence model for better performance even after the evaluation. Here, the clothing treating device 100 may perform a series of steps performed by the server 300 solely or together with the server 300.

The server 300 may include an artificial intelligence model learner which generates an artificial intelligence model trained through a deep neural network (DNN) with the collected motor current pattern. The artificial intelligence model learner of the server may be configured to extract learning data required to learn through the deep neural network from a database in which data required to classify the kind or the material of the clothing required for machine learning or deep learning is stored, pre-process the learning data to increase accuracy of the learning data, train the learning data through the deep neural network (DNN), and generate the trained artificial intelligence model.

The data preprocessing refers to increasing of accuracy of the source data as much as possible by removing or modifying the learning data. Further, when data having significantly low importance is excessively included, the data is appropriately reduced to be changed to be easily managed and used. The data preprocessing includes data cleansing, data integration, data conversion, and data reduction. The data cleansing is to fill in missing values, smooth noisy data, identify an outlier, and correct data inconsistency.

The server 300 may be configured to transmit the trained artificial intelligence model trained by the artificial intelligence model learner to the clothing treating device 100. A clothing material classifier 126 of the clothing treating device 100 may be configured to classify the material of the clothing by the trained artificial intelligence model transmitted from the server.

Figure 4:
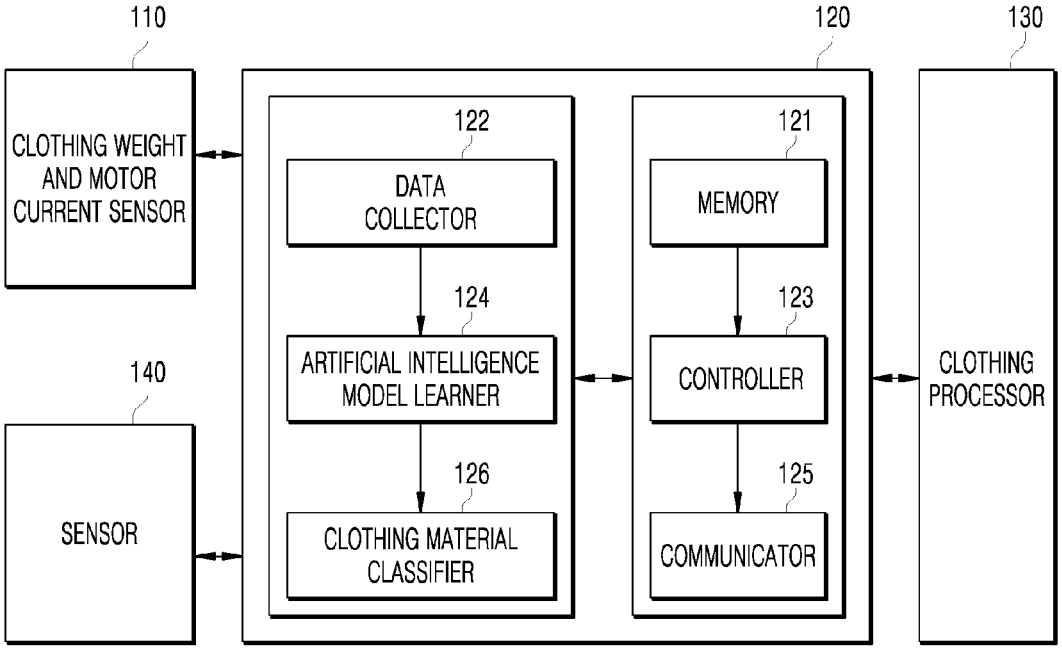
FIG. 4 is a schematic diagram of a clothing treating device including a clothing treating course controller according to an embodiment of the present disclosure.

FIG. 4 is a schematic diagram of a clothing treating device including a clothing treating course controller according to an embodiment of the present disclosure.

The clothing treating device 100 includes a clothing weight and motor current sensor 110, a clothing treating course controller 120, a clothing processor 130, and a sensor 140. In the clothing weight and motor current sensor 110, a clothing weight sensor and a motor current sensor may be separately configured or combined as one. The clothing treating course controller 120 may be buried in the clothing treating device 100, a washing machine, or a drying machine.

The clothing treating course controller 120 may include a clothing material classifier 126 which identifies a material of the clothing from data received from at least one of the clothing weight or motor current sensor 110 or the sensor 140. Further, the clothing treating course controller 120 may include a memory 121 which store various data such as a motor current pattern, image information, millimeter wave information, near infrared wavelength information, vibration information, a clothing treating course, and artificial intelligence model learning data, a communicator 125 which communicates with an external device, and a course controller 123 which controls the clothing weight and current sensor 110, the data collector 122, the artificial intelligence model learner 124, the clothing material classifier 126, the memory 132, and the communicator 125 and controls the clothing treating course of the clothing treating device 100.

The sensor 140 may include a millimeter wave sensor 141 which senses a structure of a fabric, a vision sensor 142, a near infrared ray (NIR) spectrometer 143, and a vibration sensor 144.

The course controller 123 may generate a control signal having sensing information sensed by the clothing weight and motor current sensor 110 and the sensor 140 and protocol information to communicate with the user terminal 200 and the server 300 for material information of the clothing classified by the clothing material classifier 126. The communicator 125 serves to transmit the generated control signal to the user terminal 200 and the server 300.

The course controller 123 controls the clothing processor 130 to execute the clothing treating course based on information about the material of the clothing classified by the clothing material classifier 126. Further, the course controller 123 may monitor whether the clothing treating course which is automatically executed is executed. When the clothing treating course which is automatically executed is not executed and the user stops the automatically executed clothing treating course to execute another clothing treating course, the course controller 123 may store the clothing treating course which is changed by the user in the memory 121 to be used for one-shot learning or few-shot learning. The one-shot learning or the few-shot learning may customize the performance of the clothing treating device for every home by learning the clothing material and the motor current pattern corresponding to the clothing treating course which is changed by the user.

TABLE 1

| Level | Clothing classification (material) | Course control (time) |
|---|---|---|
| 1L | Soft | Wool/knit/functional (short) |
| 2L | Normal | Suit/coat (intermediate) |
| 3L | Hard | Styling+ (long) |

In the embodiment of the present disclosure, the clothing may be classified into three levels including a soft clothing, a normal clothing, and a hard clothing depending on a material. The clothing treating course controller 120 may control the clothing treating course in accordance with the classification of the clothing. In another embodiment of the present disclosure, the clothing material may be classified into five levels including a soft material, a material between the soft material and a normal material, a normal material, a material between a hard material and a normal material, and a hard material.

The clothing material classifier 126 of the clothing treating course controller 120 may estimate the material of the clothing based on at least one of the sensed motor current pattern, image information of a color, a pattern, or an outline of a specific portion of the clothing from the photographed image, waveform information transmitted from the millimeter wave sensor 141, near infrared wavelength information from the near infrared ray spectrometer 143, or vibration information from the vibration sensor.

The clothing treating course controller 120 may train the artificial intelligence model based on data transmitted from the clothing weight and motor current sensor 110 and the sensor 140. To this end, the clothing treating course controller 120 may include a data collector 122, an artificial intelligence model learner 124, and a clothing material classifier 126. The data collector 122 may collect a motor current pattern from the clothing weight and motor current sensor 110 and data required to classify the clothing material from the sensor 140. The artificial intelligence model learner 124 learns with learning data including data related to a plurality of motor current patterns, clothing image information, millimeter wave information, near infrared wavelength information, and vibration information and data obtained by matching a label of the clothing material to the data related to the plurality of motor current patterns and trains a clothing material classifying engine to estimate and output the clothing material. The clothing material classifier 126 estimates and outputs the material of the clothing through the clothing material classifying engine based on data transmitted from the clothing weight and motor current sensor 110 and the sensor 140. The material information of the clothing output from the clothing material classifier 126 is matched to the image information of the clothing to be stored in the memory 121.

The data collector 122 may generate artificial intelligence learning data and testing data including the image information of the color, the pattern, or the outline of a specific portion of the clothing, tag related data, millimeter wave information, near infrared wavelength information, vibration information, and label data obtained by matching a label of the clothing material to data related to the motor current pattern. In one embodiment of the present disclosure, the data obtained by matching the label of the clothing material may generate data matching information about the material of the clothing obtained by recognizing a character of a tag portion of the clothing.

A ratio of the learning data and the testing data may vary depending on an amount of data, and generally may be defined as a ratio of 7:3. The learning data may be collected and stored by collecting and storing a color, a pattern, an outline, and a tag part of a specific portion of the clothing through the vision sensor 142. The learning data may be collected and stored by collecting videos and images by the server 300. The data for learning an artificial intelligence model may be subjected to data preprocessing and data augmentation processes to obtain an accurate learning result.

In another embodiment of the present disclosure, as described with reference to FIG. 3, the clothing treating course controller 120 may use the server 300 to train an artificial intelligence model which infers (or classifies) the material of the clothing. The server 300 may receive the motor current pattern, the image information of the color, the pattern, or the outline of the specific portion of the clothing, tag related data, the millimeter wave information, the near infrared wavelength information, the vibration information, and data related to the clothing material from the clothing treating device 100. The server 300 may be configured to transmit the trained artificial intelligence model trained by the artificial intelligence model learner to the clothing treating course controller 120. The clothing material classifier 126 of the clothing treating course controller 120 may be configured to classify the materials of the clothing by the trained artificial intelligence model transmitted from the server 300.

The course controller 123 of the clothing treating course controller 120 may include all kinds of devices which can process the data, like the processor, for example, an MCU. Here, 'the processor' may, for example, refer to a data processing device embedded in hardware, which has physically structured circuitry to perform a function represented by codes or instructions contained in a program. As one example of the data processing device embedded in the hardware, a microprocessor, a central processor (CPU), a processor core, a multiprocessor, an application-specific integrated circuit (ASIC), a field programmable gate array (FPGA), and the like may be included, but the scope of the present disclosure is not limited thereto.

The clothing treating course controller 120 may provide a communication interface required to provide signals transmitted/received between the user terminal 200, and/or the server 300 in the form of packet data in cooperation with the network 400. In addition, the communicator 125 may support various kinds of machine type communication (e.g. Internet of Things (IoT), Internet of Everything (IoE), and Internet of Small Things (IoST)), and may support machine to machine (M2M) communication, vehicle to everything (V2X) communication, device to device (D2D) communication, etc.

Figure 5:
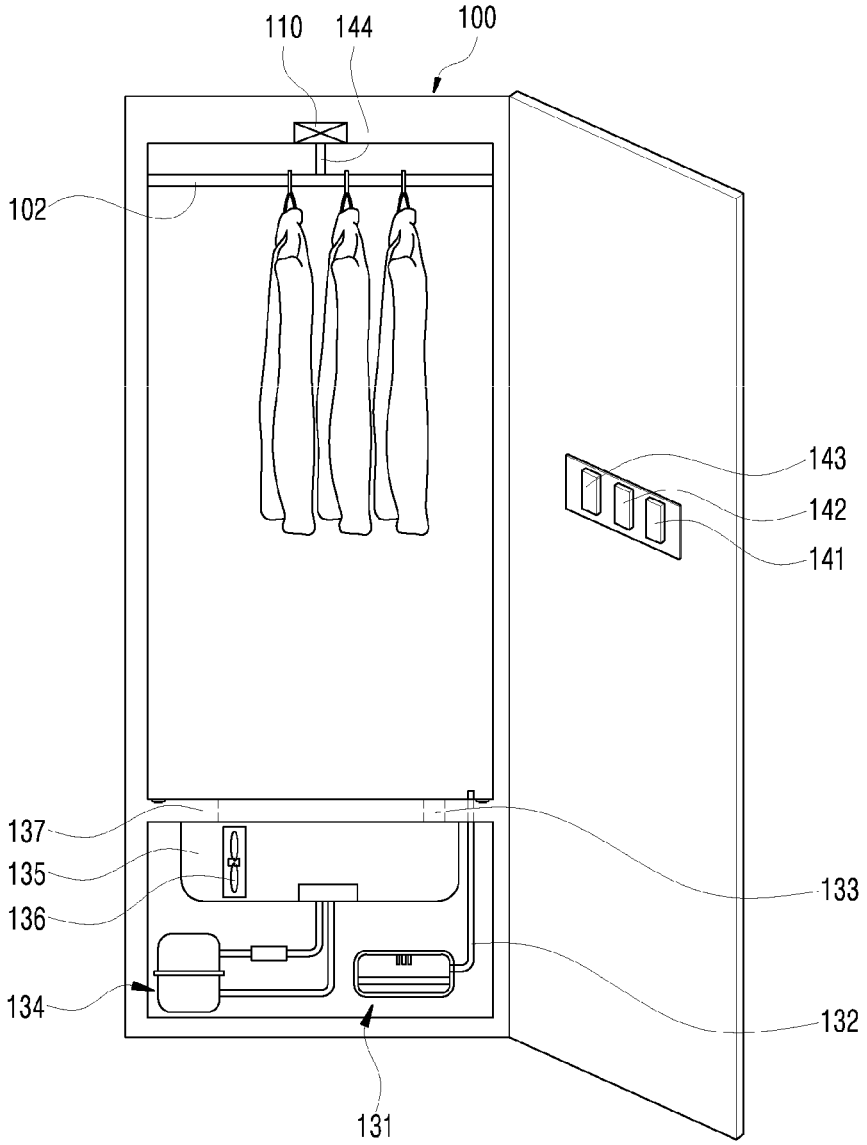
FIG. 5 is a block diagram of a clothing treating device including a clothing treating course controller according to an embodiment of the present disclosure.

FIG. 5 is a block diagram of a clothing treating device including a clothing treating course controller according to an embodiment of the present disclosure.

The clothing weight and motor current sensor 110 senses a weight of the clothing hung on a hanger 102 and senses a motor current of a motor (not illustrated) which vibrates the hanger 102. The clothing weight may be determined by a difference between the hanger 102 and the hanger 102 on which the clothing is hung. The hanger 102 is vibrated to increase the clothing treating effect. A driver (not illustrated) which causes the vibration converts a torque of a motor (not illustrated) into a vibration motion which swings in one axial direction or two or more axial directions. The vibration motion of the hanger 102 emphasizes an effect of ironing wrinkles of the clothing and helps steam and hot air to be more smoothly permeated into the clothing.

The clothing processor 130 may execute various operations for treating the clothing. The clothing processor 130 includes a steam supplier 131, a steam supplying pipe 132, a hot air supplier 125, a supplying duct 135, a blast fan 136, an inlet 137, and an outlet 133. The hot air supplier 125 supplies hot air to a clothing accommodating space of the clothing treating device 100 to dry the clothing disposed in the accommodating space. The hot air supplier 125 may use a method of supplying the generated heat to the accommodating space after generating heat using a heat pump and a method of supplying the generated het to the accommodating space after generating heat using an electric heater. However, the present disclosure is not limited thereto, but includes all devices which supply heat using different methods. The supplying duct 135 supplies the generated heat to the accommodating space after generating heat using a heat pump or supplies the generated heat to the accommodating space after generating heat using an electric heater. The inlet 137 which transmits the hot air is formed at one side between the supplying duct 135 and the accommodating space and the outlet 133 through which the air of the accommodating space is discharged is formed at the other side between the supplying duct 135 and the accommodating space. The above-described outlet 133 and inlet 137 may communicate with one side and the other side of the supplying duct 135, respectively. However, the present disclosure is not limited thereto, but includes all devices which supply heat using different methods.

The sensor 140 may include a millimeter wave sensor 141 which senses a structure of a fabric, a vision sensor 142 which obtains video/image information, a near infrared spectrometer 143 which obtains near infrared wavelength information, and a vibration sensor 144 which obtains vibration information of the motor.

The millimeter wave (mmwave) sensor 141 is a sensing technique which is very useful to sense an object and figure out a range, a speed, and an angle of the object. This technique is a contactless technique which operates at a spectrum of 30 GHz to 300 GHz and uses a short wavelength to provide an accuracy in the range of less than 1 mm, and passes through an object such as a clothing. The millimeter wave sensor transmits a signal using a wavelength within a range of millimeter (mm), which is considered as a short wavelength in an electromagnetic spectrum. Actually, a size of a system component such as an antenna which is required to process a mmWave signal is small and a short wavelength has a high resolution. The mmWave system which checks a distance from the wavelength may have an accuracy in the millimeter range at 76 to 81 GHz. In one embodiment, the material of the clothing may be identified by the artificial intelligence model learning using the millimeter wave sensor.

The near infrared spectrometer (NIR spectrometer) 143 is based on NIR Scan™ Nano design of Texas Instruments and operates in a wavelength range of 900 nm to 1700 nm. The near infrared spectrometer may determine a composition of a fabric (for example, blended with 60% of cotton and 40% of polyester or 100% of wool) using a near infrared wavelength. In one embodiment, the near infrared (NIR) spectrometer may identify the material of the clothing or a kind of the fabric by the artificial intelligence model learning using the near infrared wavelength.

The vision sensor 142 may photograph to obtain an image required to identify the material of the clothing and may photograph the tag of the clothing and the color, the pattern, or the outline of the specific portion of the clothing at a specific resolution. The vision sensor 142 may be a camera and photograph an image of a tag part of the clothing. The tag part of the clothing is recognized as a character through a character recognizing artificial intelligence algorithm to provide information about a material, a brand, and washing information of the clothing. The character recognizing artificial intelligence algorithm may be configured using an optical character recognition (OCR) or may be configured using a library of a tensorflow or Python AI library. When the tag information is recognized to obtain information about the clothing material, the material of the clothing is identified without using a device or a process of identifying the clothing material. However, the tag information cannot be readable as the number of washing increases. Therefore, when the tag information is photographed by the vision sensor in a readable state, information about the material of the clothing is stored in the memory by being matched with the color, the pattern, or the outline of the specific portion of the clothing to determine the material of the clothing by any one of the color, the pattern, or the outline of the specific portion of the clothing. Further, the tag information is also used as a label value of an artificial intelligence model which learns the clothing material of the learning data at the time of supervised learning of the artificial intelligence model.

Figure 6:
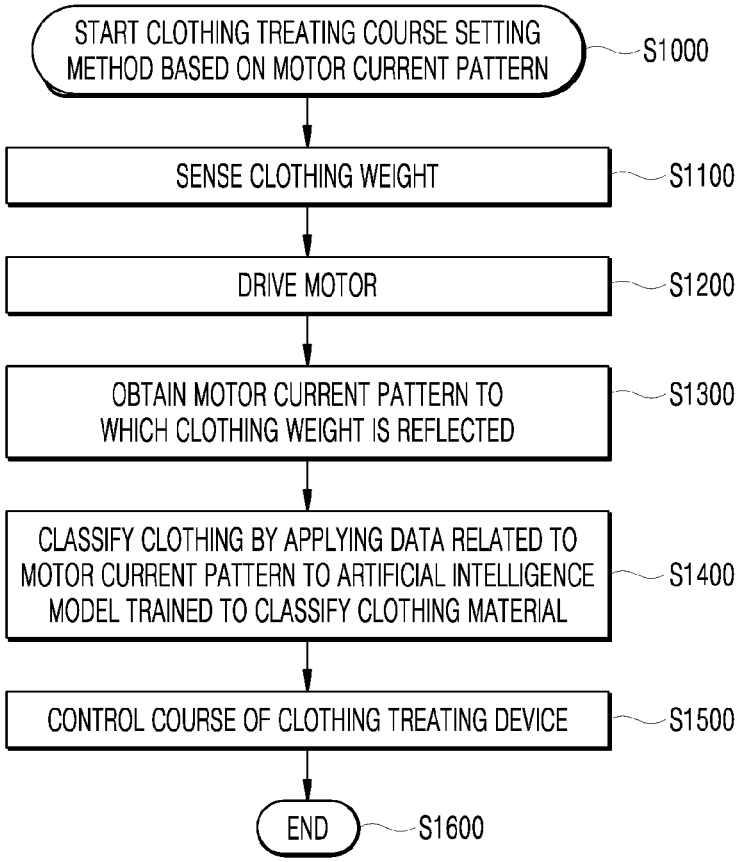
FIG. 6 is a flowchart of a method of controlling to execute a clothing treating course according to an embodiment of the present disclosure.

FIG. 6 is a flowchart of a method of controlling to execute a clothing treating course according to an embodiment of the present disclosure.

The clothing treating course controller 120 may be turned on when the clothing treating device 100 is turned on. Further, the clothing treating course controller 120 may be turned on by a user's setting. When the clothing treating course controller 120 is turned on, a clothing treating course executing control process starts based on motor current pattern information in step S1000.

The clothing treating course controller 120 senses a clothing weight by the clothing weight and motor current sensor 110 in step S1100. Further, the clothing treating course controller 120 may obtain image information of the clothing through the vision sensor 142. The clothing treating course controller 120 may collect the photographed image as it is, resize an entire screen of the image, or crop a part of the entire screen to collect data related to the entire screen. When an image of a specific portion having a feature which is distinguished from the other clothing, such as a sleeve portion, a button portion, a neck portion, and an end portion of bottoms, is photographed by the visions sensor 142, the image is matched with the image of the clothing so that the material of the clothing can be accurately and quickly estimated. In another embodiment, the clothing treating course controller 120 obtains information of the waveform from the clothing by the millimeter wave sensor 141 or information of a near infrared wavelength from the clothing by the near infrared (NIR) spectrometer 143. Further, information about the vibration of the motor may be obtained by the vibration sensor 144.

When a motor (not illustrated) of the clothing treating device 100 is driven in step S1200, a motion of a rotary shaft equipped in the motor (not illustrated) is converted into a linear reciprocating motion to be transmitted to the hanger 102 and the clothing weight and motor current sensor 110 may obtain a pattern of the motor current to which the clothing weight is reflected in step S1300.

The clothing treating course controller 120 may apply data related to the sensed motor current pattern to an artificial intelligence model trained to classify the material of the clothing and output information about the classified material of the clothing from the trained artificial intelligence model in step S1400. In the embodiment of the present disclosure, the clothing material may be classified into three levels of a soft material, a normal material, and a hard material, as represented in Table 1. In another embodiment of the present disclosure, the clothing may be classified into five levels including a soft material, a material between the soft material and a normal material, the normal material, a material between a hard material and the normal material, and the hard material.

The clothing treating course controller 120 may control the clothing treating course of the clothing treating device 100 to be executed based on the information about the classified clothing material in step S1500. As represented in Table 1, the clothing treating course controller 120 may control to execute a wool/knit/functional clothing treating course for the classified soft material, a suit/coat clothing treating course for the normal material, and a styling+ course for the hard material. The control of the clothing treating course is not limited to the embodiment of Table 1. In another embodiment, when the clothing material is classified into five levels of a soft material 1L, a material 2L between soft and normal materials, a normal material 3L, a material 41 between normal and hard materials, and a hard material 5L, the clothing treating course controller 120 may control to execute a wool/knit clothing treating course, a functional clothing treating course, a suit/coat clothing treating course 1, a suit/coat clothing treating course 2, and a styling+ course for the five-level classification.

When the clothing treating course of the clothing treating device 100 is controlled to be executed, the clothing treating course executing control process ends in step S1600.

In another embodiment of the present disclosure, a program which is programmed to execute the clothing material classifying method may be stored in a computer readable recording medium.

Figure 7:
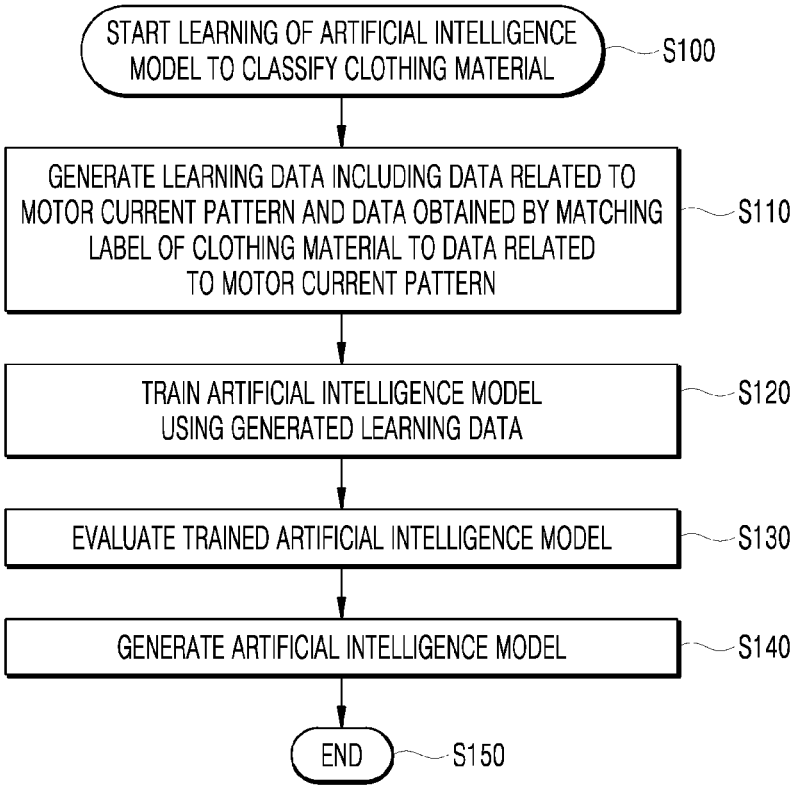
FIG. 7 is a flowchart of training a clothing material classifying engine by an artificial intelligence model learner according to an embodiment of the present disclosure.
Figure 8A:
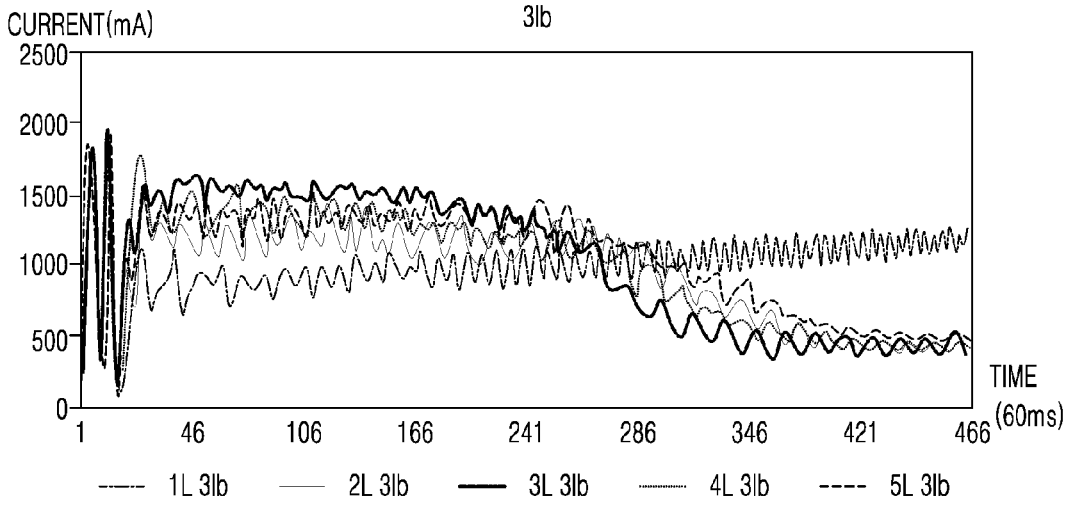
FIGS. 8A to 8D are exemplary diagrams of motor current patterns to which a clothing weight is reflected, according to an embodiment of the present disclosure.
Figure 8B:
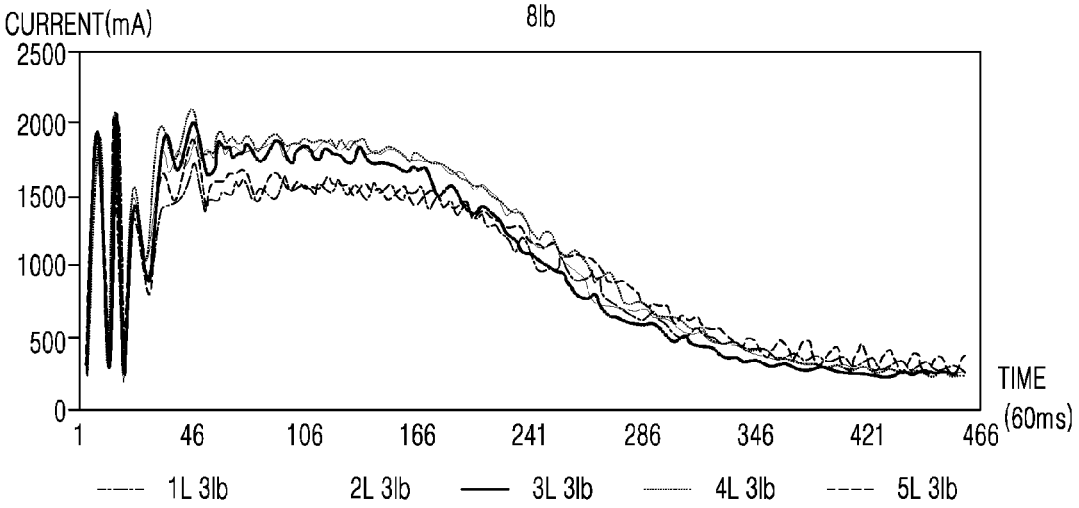
Figure 8C:
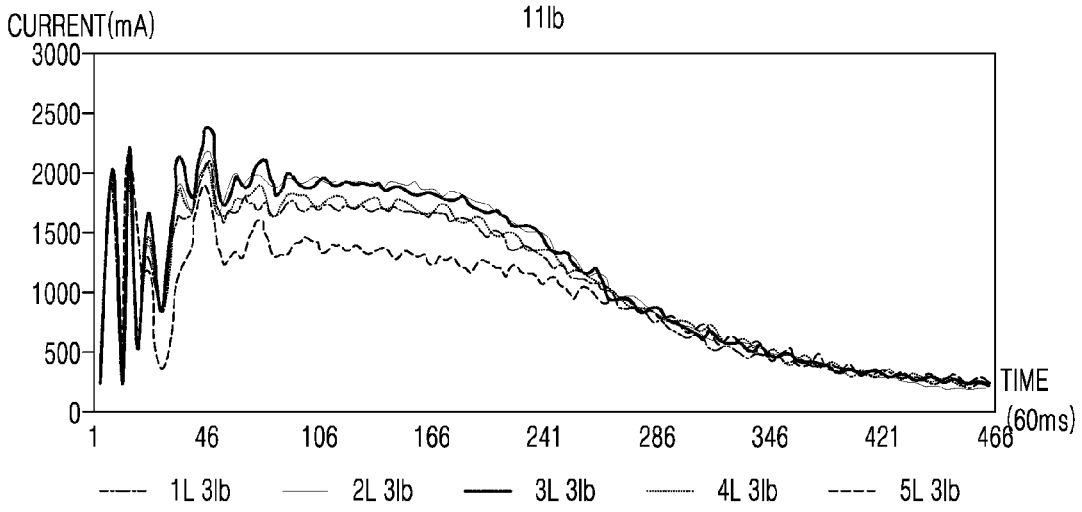
Figure 8D:
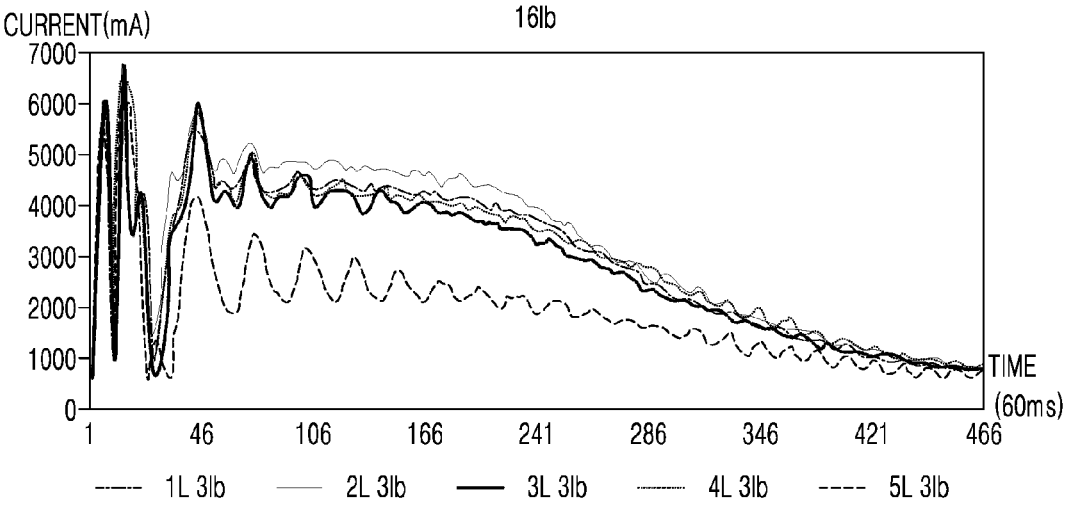

FIG. 7 is a flowchart of training a clothing material classifying engine by an artificial intelligence model learner according to an embodiment of the present disclosure.

Referring to FIG. 6, a process of training an artificial intelligence model which classifies the material of the clothing is illustrated and the process can be included in step S1400. The training of an artificial intelligence model, which is applicable to the clothing treating course controller 120, starts to identify the material of the clothing in step S100.

Artificial intelligence model learning data including data related to a plurality of motor current patterns and label data obtained by matching a label of the clothing material to the data related to the motor current pattern may be generated in step S110.

The artificial intelligence model, for example, an artificial neural network such as CNN learns features of the material of the clothing using learning data collected through the supervised learning in step S120. The artificial intelligence model learner 124 may perform artificial intelligence based convolution neural network (CNN), recurrent neural network (RNN), and long short-term memory (LSTM) based on the obtained motor current pattern to estimate the clothing material.

The artificial intelligence model is generated through evaluation of the trained artificial intelligence model (S130) in step S140. The trained artificial intelligence model may be evaluated (S130) using testing data. Throughout the present specification, the "trained artificial intelligence model" may refer to determining of the model trained after training the learning data and testing using the testing data, without being specifically mentioned. Artificial intelligence techniques which are applicable to the artificial intelligence model to learn the clothing material classifying method will be described with reference to FIG. 9.

FIGS. 8A to 8D are exemplary diagrams of motor current patterns to which a clothing weight is reflected, according to an embodiment of the present disclosure.

FIGS. 8A to 8D illustrate a motor current pattern of a clothing having five levels in accordance with a weight (3 lb, 8 lb, 11 lb, and 16 lb) of the clothing, for example, a soft material 1L, a material 2L between soft and normal materials, a normal material 3L, a material 4L between hard and normal materials, and a hard material 5L.

The clothing of the soft material 1L shows a pattern in which the motor current moderately increases over time in 3 lb, increases and then decreases in 8 lb, and increases and then decreases more than in 8 lb in 11 lb, and increases to 6000 mA and then decreases to 2000 mA in 16 lb.

The clothing of the hard material 5L shows a pattern in which the motor current moderately decreases below 1500 mA over time, maintains above 1500 mA and then moderately decreases in 8 lb, maintains below 1500 mA which is lower than the pattern of 8 lb and then moderately decreases in 11 lb, and increases to 6000 mA and then decreases between 4000 mA and 2000 mA in 16 lb.

As described above, it is confirmed that the clothing material has a unique motor current pattern in accordance with a weight of the clothing. Therefore, the artificial intelligence model which classifies the clothing material may be trained by learning the weight of the clothing and the motor current pattern.

Figure 9:
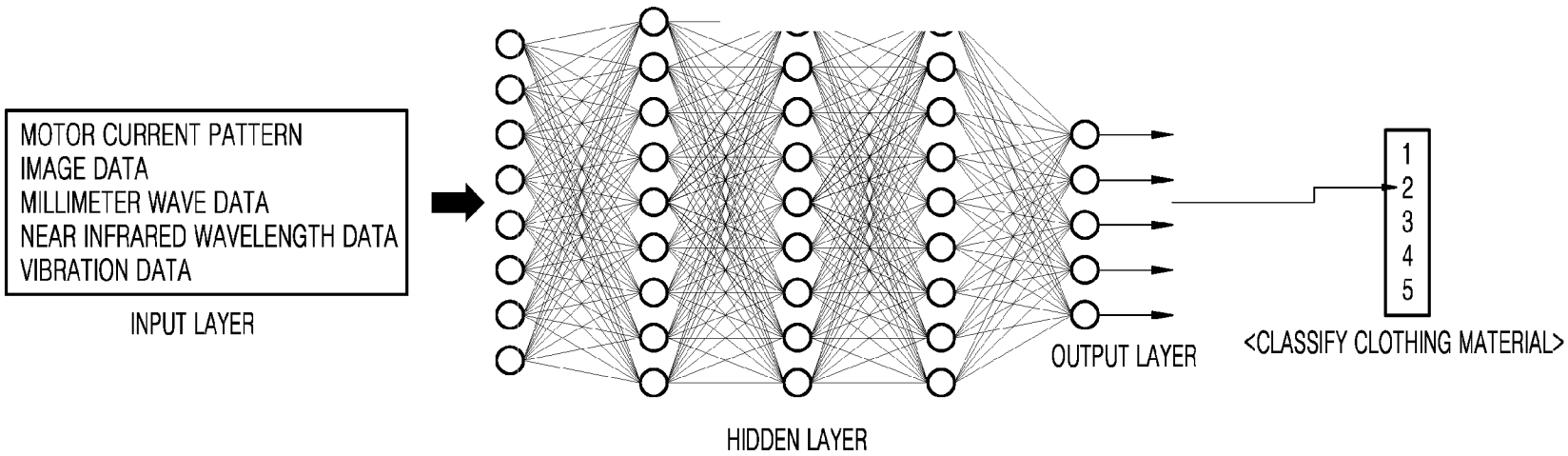
FIG. 9 is an exemplary diagram of an artificial neural network according to an embodiment of the present disclosure.

FIG. 9 is an exemplary diagram of an artificial neural network according to an embodiment of the present disclosure.

The artificial intelligence (AI) is one field of computer science and information technology that studies methods to make computers mimic intelligent human behaviors such as reasoning, learning, self-improving and the like.

In addition, the artificial intelligence does not exist on its own, but is rather directly or indirectly related to a number of other fields in computer science. In recent years, there have been numerous attempts to introduce an element of AI into various fields of information technology to solve problems in the respective fields.

Machine learning is an area of artificial intelligence that includes the field of study that gives computers the capability to learn without being explicitly programmed.

More specifically, machine learning is a technology that investigates and builds systems, and algorithms for such systems, which are capable of learning, making predictions, and enhancing their own performance on the basis of experiential data. Machine learning algorithms, rather than only executing rigidly set static program commands, may take an approach that builds models for deriving predictions and decisions from inputted data.

Many Machine Learning algorithms have been developed on how to classify data in the Machine Learning. Representative examples of such machine learning algorithms for data classification include a decision tree, a Bayesian network, a support vector machine (SVM), an artificial neural network (ANN), and so forth.

Decision tree refers to an analysis method that uses a tree-like graph or model of decision rules to perform classification and prediction.

Bayesian network may include a model that represents the probabilistic relationship (conditional independence) among a set of variables. Bayesian network may be appropriate for data mining via unsupervised learning.

SVM may include a supervised learning model for pattern detection and data analysis, heavily used in classification and regression analysis.

ANN is a data processing system modelled after the mechanism of biological neurons and interneuron connections, in which a number of neurons, referred to as nodes or processing elements, are interconnected in layers.

ANNs are models used in machine learning and may include statistical learning algorithms conceived from biological neural networks (particularly of the brain in the central nervous system of an animal) in machine learning and cognitive science.

ANNs may refer generally to models that have artificial neurons (nodes) forming a network through synaptic interconnections, and acquires problem-solving capability as the strengths of synaptic interconnections are adjusted throughout training.

The terms 'artificial neural network' and 'neural network' may be used interchangeably herein.

An ANN may include a number of layers, each including a number of neurons. In addition, the Artificial Neural Network can include the synapse for connecting between neuron and neuron.

An ANN may be defined by the following three factors: (1) a connection pattern between neurons on different layers; (2) a learning process that updates synaptic weights; and (3)

an activation function generating an output value from a weighted sum of inputs received from a lower layer.

ANNs include, but are not limited to, network models such as a deep neural network (DNN), a recurrent neural network (RNN), a bidirectional recurrent deep neural network (BRDNN), a multilayer perception (MLP), and a convolutional neural network (CNN).

An ANN may be classified as a single-layer neural network or a multi-layer neural network, based on the number of layers therein.

In general, a single-layer neural network may include an input layer and an output layer.

Further, in general, a multi-layer neural network may include an input layer, one or more hidden layers, and an output layer.

The Input layer is a layer that accepts external data, the number of neurons in the Input layer is equal to the number of input variables, and the Hidden layer is disposed between the Input layer and the Output layer and receives a signal from the Input layer to extract the characteristics to transfer it to the Output layer. The output layer receives a signal from the hidden layer and outputs an output value based on the received signal. Input signals between the neurons are summed together after being multiplied by corresponding connection strengths (synaptic weights), and if this sum exceeds a threshold value of a corresponding neuron, the neuron can be activated and output an output value obtained through an activation function.

In the meantime, a deep neural network with a plurality of hidden layers between the input layer and the output layer may be the most representative type of artificial neural network which enables deep learning, which is one machine learning technique.

The Artificial Neural Network can be trained by using training data. Herein, the training can mean a process of determining a parameter of the Artificial Neural Network by using training data in order to achieve the objects such as classification, regression, clustering, etc. of input data. As a representative example of the parameter of the Artificial Neural Network, there can be a weight given to a synapse or a bias applied to a neuron.

An artificial neural network trained using training data can classify or cluster inputted data according to a pattern within the inputted data.

Throughout the present specification, an artificial neural network trained using training data may be referred to as a trained model.

Hereinbelow, learning paradigms of an artificial neural network will be described in detail.

The learning method of the Artificial Neural Network can be largely classified into Supervised Learning, Unsupervised Learning, Semi-supervised Learning, and Reinforcement Learning.

The Supervised Learning is a method of the Machine Learning for inferring one function from the training data.

Then, among the thus inferred functions, outputting consecutive values is referred to as regression, and predicting and outputting a class of an input vector is referred to as classification.

In the Supervised Learning, the Artificial Neural Network is learned in a state where a label for the training data has been given.

Here, the label may refer to a target answer (or a result value) to be guessed by the artificial neural network when the training data is inputted to the artificial neural network.

Throughout the present specification, the target answer (or a result value) to be guessed by the artificial neural network when the training data is inputted may be referred to as a label or labeling data.

Throughout the present specification, assigning one or more labels to training data in order to train an artificial neural network may be referred to as labeling the training data with labeling data.

Training data and labels corresponding to the training data together may form a single training set, and as such, they may be inputted to an artificial neural network as a training set.

The training data may exhibit a number of features, and the training data being labeled with the labels may be interpreted as the features exhibited by the training data being labeled with the labels. In this case, the training data may represent a feature of an input object as a vector.

Using training data and labeling data together, the artificial neural network may derive a correlation function between the training data and the labeling data. Then, the parameter of the Artificial Neural Network can be determined (optimized) by evaluating the function inferred from the Artificial Neural Network.

Unsupervised learning is a machine learning method that learns from training data that has not been given a label.

More specifically, unsupervised learning may be a training scheme that trains an artificial neural network to discover a pattern within given training data and perform classification by using the discovered pattern, rather than by using a correlation between given training data and labels corresponding to the given training data.

Examples of unsupervised learning include clustering and independent component analysis.

Examples of artificial neural networks using unsupervised learning include, but are not limited to, a generative adversarial network (GAN) and an autoencoder (AE).

GAN is a machine learning method in which two different artificial intelligences, a generator and a discriminator, improve performance through competing with each other.

The generator may be a model generating new data that generates new data based on true data.

The discriminator may be a model recognizing patterns in data that determines whether inputted data is from the true data or from the new data generated by the generator.

Furthermore, the generator may receive and learn from data that has failed to fool the discriminator, while the discriminator may receive and learn from data that has succeeded in fooling the discriminator. Accordingly, the generator may evolve so as to fool the discriminator as effectively as possible, while the discriminator evolves so as to distinguish, as effectively as possible, between the true data and the data generated by the generator.

An auto-encoder (AE) is a neural network which aims to reconstruct its input as output.

More specifically, AE may include an input layer, at least one hidden layer, and an output layer.

Since the number of nodes in the hidden layer is smaller than the number of nodes in the input layer, the dimensionality of data is reduced, thus leading to data compression or encoding.

Furthermore, the data outputted from the hidden layer may be inputted to the output layer. Given that the number of nodes in the output layer is greater than the number of nodes in the hidden layer, the dimensionality of the data increases, thus leading to data decompression or decoding.

Furthermore, in the AE, the inputted data is represented as hidden layer data as interneuron connection strengths are adjusted through training. The fact that when representing information, the hidden layer is able to reconstruct the inputted data as output by using fewer neurons than the input layer may indicate that the hidden layer has discovered a hidden pattern in the inputted data and is using the discovered hidden pattern to represent the information.

Semi-supervised learning is machine learning method that makes use of both labeled training data and unlabeled training data.

One semi-supervised learning technique involves reasoning the label of unlabeled training data, and then using this reasoned label for learning. This technique may be used advantageously when the cost associated with the labeling process is high.

Reinforcement learning may be based on a theory that given the condition under which a reinforcement learning agent can determine what action to choose at each time instance, the agent can find an optimal path to a solution solely based on experience without reference to data.

Reinforcement learning may be performed mainly through a Markov decision process (MDP).

Markov decision process consists of four stages: first, an agent is given a condition containing information required for performing a next action; second, how the agent behaves in the condition is defined; third, which actions the agent should choose to get rewards and which actions to choose to get penalties are defined; and fourth, the agent iterates until future reward is maximized, thereby deriving an optimal policy.

An artificial neural network is characterized by features of its model, the features including an activation function, a loss function or cost function, a learning algorithm, an optimization algorithm, and so forth. Also, the hyperparameters are set before learning, and model parameters can be set through learning to specify the architecture of the artificial neural network.

For instance, the structure of an artificial neural network may be determined by a number of factors, including the number of hidden layers, the number of hidden nodes included in each hidden layer, input feature vectors, target feature vectors, and so forth.

Hyperparameters may include various parameters which need to be initially set for learning, much like the initial values of model parameters. Also, the model parameters may include various parameters sought to be determined through learning.

For instance, the hyperparameters may include initial values of weights and biases between nodes, mini-batch size, iteration number, learning rate, and so forth. Furthermore, the model parameters may include a weight between nodes, a bias between nodes, and so forth.

Loss function may be used as an index (reference) in determining an optimal model parameter during the learning process of an artificial neural network. Learning in the artificial neural network involves a process of adjusting model parameters so as to reduce the loss function, and the purpose of learning may be to determine the model parameters that minimize the loss function.

Loss functions typically use means squared error (MSE) or cross entropy error (CEE), but the present disclosure is not limited thereto.

Cross-entropy error may be used when a true label is one-hot encoded. One-hot encoding may include an encoding method in which among given neurons, only those corresponding to a target answer are given 1 as a true label value, while those neurons that do not correspond to the target answer are given 0 as a true label value.

In machine learning or deep learning, learning optimization algorithms may be deployed to minimize a cost function, and examples of such learning optimization algorithms include gradient descent (GD), stochastic gradient descent (SGD), momentum, Nesterov accelerate gradient (NAG), Adagrad, AdaDelta, RMSProp, Adam, and Nadam.

GD includes a method that adjusts model parameters in a direction that decreases the output of a cost function by using a current slope of the cost function.

The direction in which the model parameters are to be adjusted may be referred to as a step direction, and a size by which the model parameters are to be adjusted may be referred to as a step size.

Here, the step size may mean a learning rate.

GD obtains a slope of the cost function through use of partial differential equations, using each of model parameters, and updates the model parameters by adjusting the model parameters by a learning rate in the direction of the slope.

SGD may include a method that separates the training dataset into mini batches, and by performing gradient descent for each of these mini batches, increases the frequency of gradient descent.

Adagrad, AdaDelta and RMSProp may include methods that increase optimization accuracy in SGD by adjusting the step size, and may also include methods that increase optimization accuracy in SGD by adjusting the momentum and step direction. Adam may include a method that combines momentum and RMSProp and increases optimization accuracy in SGD by adjusting the step size and step direction. Nadam may include a method that combines NAG and RMSProp and increases optimization accuracy by adjusting the step size and step direction.

Learning rate and accuracy of an artificial neural network rely not only on the structure and learning optimization algorithms of the artificial neural network but also on the hyperparameters thereof. Therefore, in order to obtain a good learning model, it is important to choose a proper structure and learning algorithms for the artificial neural network, but also to choose proper hyperparameters.

In general, the artificial neural network is first trained by experimentally setting hyperparameters to various values, and based on the results of training, the hyperparameters can be set to optimal values that provide a stable learning rate and accuracy.

The learning of the artificial intelligence model which identifies a material of the clothing or a kind of the clothing may be performed by any one of supervised learning, unsupervised learning, and reinforcement learning.

The convolution neural network is the most representative method of a deep neural network and specializes an image from a small feature to a complex feature. The CNN is an artificial neural network having a structure which is configured by one or a plurality of convolution layers and general artificial neural network layers disposed thereon to perform the preprocessing on the convolution layer. For example, in order to learn an image of a human face through the CNN, first, simple features are extracted using a filter to create one convolution layer and a new layer, for example, a pooling layer which extracts a more complex feature from the features is added. The convolution layer is a layer which extracts features through a convolution operation and performs a multiplication with a regular pattern. The pooling layer is a layer which abstracts an input space and reduces a dimension of an image through sub sampling. For example, a face image with a size of 28×28 is changed into feature maps of 24×24 using four filters with a stride of 1 and compressed into 12×12 by subsampling (or pooling). In a next layer, 12 picture maps with a size of 8×8 is created and then subsampled to be 4×4 to finally learn with a neural network having 192 (=12×4×4) inputs to classify the image. A plurality of convolution layers is connected to extract a feature of the image and finally learning is performed using an error backpropagation neural network of the related art. The advantage of the CNN is to create a filter which characterizes a feature of the image through the artificial neural network learning by itself.

In the embodiment of the present disclosure, the CNN artificial neural network model may have a deep neural network structure having data of one motor current pattern as an input layer, five hidden layers, and five output layers for clothing having a soft material 1L, a material 2L between soft and normal materials, a normal material 3L, a material 4L between hard and normal materials, and a hard material 5L.

In another embodiment of the present disclosure, the CNN artificial neural network model may have a deep neural network structure having at least one of a motor current pattern, image data for a color, a pattern, a button, a sleeve outline, a leg outline, or a neck outline, millimeter wave data, near infrared wavelength data, and vibration data as an input layer, five hidden layers, and five output layers for clothing having a soft material 1L, a material 2L between soft and normal materials, a normal material 3L, a material 4L between hard and normal materials, and a hard material 5L. In another embodiment of the present disclosure, the CNN artificial neural network model may have a deep neural network structure having three output layers for clothing having a soft material 1L, a normal material 2L, and a hard material 3L.

In the embodiment of the present disclosure, an artificial intelligence language library such as TensorFlow or Keras which is used for artificial intelligence programming may be used to learn a deep learning based artificial intelligence.

In another embodiment of the present disclosure, one-shot learning or few-shot learning which generalizes to satisfactorily process new data only with one or few number of motor current data may be applied to the clothing material classifying engine. A first method may initialize using a previously learned clothing material classifying engine and then minutely tune the network using learning data of one shot learning or few shot learning. When the course controller 123 automatically executes a clothing treating course corresponding to a clothing material classified by the clothing material classifier 126 based on a current motor pattern and then monitors whether there is a change in the clothing treating course. When the clothing treating course is changed, the learning data of the one shot learning or few shot learning data may use data related to the current motor pattern and label data obtained by matching a label of the clothing material corresponding to the clothing treating course to the data related to the current motor pattern as the learning data. Conversely to the determination of a clothing treating course corresponding to the clothing material classified in Table 1, the user trains the clothing material classifying engine with learning data to which the material of the clothing corresponding to the changed clothing treating course to upgrade the clothing material classifying engine. In another embodiment of the present disclosure, a second method may train the clothing material classifying engine using a method of classifying using a unit which can measure a similarity difference between classes after converting learning data into a low-dimensional space which satisfactorily expresses a feature of a high dimensional learning data. In another embodiment, a third method may resolve the insufficiency of the learning data by extending similar data to the learning data of the motor current pattern and the clothing material data using a generator model such as a generative adversarial network (GAN) for few learning data and can be combined with the second method.

The embodiments of the present disclosure described above may be implemented through computer programs executable through various components on a computer, and such computer programs may be recorded in computer-readable media. For example, the recording media may include magnetic media such as hard disks, floppy disks, and magnetic media such as a magnetic tape, optical media such as CD-ROMs and DVDs, magneto-optical media such as floptical disks, and hardware devices specifically configured to store and execute program commands, such as ROM, RAM, and flash memory.

Meanwhile, the computer programs may be those specially designed and constructed for the purposes of the present disclosure or they may be of the kind well known and available to those skilled in the computer software arts. Examples of program code include both machine codes, such as produced by a compiler, and higher level code that may be executed by the computer using an interpreter.

As used in the present application (especially in the appended claims), the terms "a/an" and "the" include both singular and plural references, unless the context clearly conditions otherwise. Also, it should be understood that any numerical range recited herein is intended to include all sub-ranges subsumed therein (unless expressly indicated otherwise) and accordingly, the disclosed numeral ranges include every individual value between the minimum and maximum values of the numeral ranges.

Operations constituting the method of the present disclosure may be performed in appropriate order unless explicitly described in terms of order or described to the contrary. The present disclosure is not necessarily limited to the order of operations given in the description. All examples described herein or the terms indicative thereof ("for example," etc.) used herein are merely to describe the present disclosure in greater detail. Therefore, it should be understood that the scope of the present disclosure is not limited to the example embodiments described above or by the use of such terms unless limited by the appended claims. Therefore, it should be understood that the scope of the present disclosure is not limited to the example embodiments described above or by the use of such terms unless limited by the appended claims. Also, it should be apparent to those skilled in the art that various alterations, substitutions, and modifications may be made within the scope of the appended claims or equivalents thereof.

Therefore, technical ideas of the present disclosure are not limited to the above-mentioned embodiments, and it is intended that not only the appended claims, but also all changes equivalent to claims, should be considered to fall within the scope of the present disclosure.

What is claimed is:

1. A device configured to control a clothing treating course, the device comprising:

a hanger configured to hang a clothing;

a weight sensor configured to sense a weight of the clothing hung on the hanger;

a motor configured to vibrate the hanger;

a motor current sensor configured to, based on operation of the motor, sense a motor current pattern applied to the motor in accordance with the weight of the clothing;

a clothing material classifier configured to classify a clothing material of the clothing based on the motor current pattern; and a course controller configured to determine the clothing treating course according to the clothing material and execute the clothing treating course determined according to the clothing material, wherein the clothing material classifier is configured to apply data related to the motor current pattern to an artificial intelligence model that is trained to classify the clothing material and output information about the clothing material, and wherein the artificial intelligence model comprises a clothing material classifying engine that is trained with learning data to classify and output the clothing material, the learning data including motor current data related to a plurality of motor current patterns and label data obtained by matching the motor current data to labels of clothing materials.

2. The device according to claim 1, wherein the clothing material classifying engine is trained to classify the clothing material through a convolution neural network (CNN) based on the motor current data.

3. The device according to claim 1, further comprising:

a non-transitory memory, wherein the course controller is configured to:

monitor whether a user changes the clothing treating course determined to be executed, and based on a determination that the user changes the clothing treating course to a changed clothing treating course, store the changed clothing treating course in the non-transitory memory, and wherein the artificial intelligence model is trained to output a clothing material corresponding to the changed clothing treating course by a one-shot learning or few-shot learning process with updated learning data including motor current data corresponding to the changed clothing treating course and label data obtained by matching the motor current data corresponding to the changed clothing treating course to a label of the clothing material corresponding to the changed clothing treating course.

4. A device configured to control a clothing treating course, the device comprising:

a hanger configured to hang a clothing;

a weight sensor configured to sense a weight of the clothing hung on the hanger;

a motor configured to vibrate the hanger;

a motor current sensor configured to, based on operation of the motor, sense a motor current pattern applied to the motor in accordance with the weight of the clothing;

a clothing material classifier configured to classify a clothing material of the clothing based on the motor current pattern;

a course controller configured to determine the clothing treating course according to the clothing material and execute the clothing treating course determined according to the clothing material; and a vision sensor configured to obtain image information about a portion of the clothing, wherein the clothing material classifier is configured to apply data related to the motor current pattern to an artificial intelligence model that is trained to classify the clothing material and output information about the clothing material, and wherein the artificial intelligence model comprises a clothing material classifying engine that is trained with learning data to classify and output the clothing material, the learning data including image information of a color, a pattern, or an outline of the portion of the clothing, the data related to the motor current pattern, and label data obtained by matching the data related to the motor current pattern to a label of the clothing material.

5. A device configured to control a clothing treating course the device comprising:

a hanger configured to hang a clothing;

a weight sensor configured to sense a weight of the clothing hung on the hanger;

a motor configured to vibrate the hanger;

a motor current sensor configured to, based on operation of the motor, sense a motor current pattern applied to the motor in accordance with the weight of the clothing;

a millimeter wave (mmWave) sensor configured to obtain information of a waveform from the clothing;

a clothing material classifier configured to classify a clothing material of the clothing based on the motor current pattern; and a course controller configured to determine the clothing treating course according to the clothing material and execute the clothing treating course determined according to the clothing material, wherein the clothing material classifier is configured to apply data related to the motor current pattern to an artificial intelligence model that is trained to classify the clothing material and output information about the clothing material, and wherein the artificial intelligence model comprises a clothing material classifying engine that is trained with learning data to classify and output the clothing material, the learning data including data related to the waveform from the clothing, the data related to the motor current pattern, and label data obtained by matching the data related to the motor current pattern to a label of the clothing material.

6. A device configured to control a clothing treating course the device comprising:

a hanger configured to hang a clothing;

a weight sensor configured to sense a weight of the clothing hung on the hanger;

a motor configured to vibrate the hanger;

a motor current sensor configured to, based on operation of the motor, sense a motor current pattern applied to the motor in accordance with the weight of the clothing;

a near infrared (NIR) spectrometer configured to obtain information of a near infrared wave from the clothing;

a clothing material classifier configured to classify a clothing material based on the motor current pattern; and a course controller configured to determine the clothing treating course according to the clothing material and execute the clothing treating course determined according to the clothing material.

wherein the clothing material classifier is configured to apply data related to the motor current pattern to an artificial intelligence model that is trained to classify the clothing material and output information about the clothing material, and wherein the artificial intelligence model comprises a clothing material classifying engine that is trained with learning data to classify and output the clothing material, the learning data including data related to the near infrared wave from the clothing, the data related to the motor current pattern, and label data obtained by matching the data related to the motor current pattern to a label of the clothing material.

7. A device configured to control a clothing treating course the device comprising:

a hanger configured to hang a clothing;

a weight sensor configured to sense a weight of the clothing hung on the hanger;

a motor configured to vibrate the hanger;

a motor current sensor configured to, based on operation of the motor, sense a motor current pattern applied to the motor in accordance with the weight of the clothing;

a vibration sensor configured to sense a vibration signal corresponding to vibration of the hanger;

a clothing material classifier configured to classify a clothing material of the clothing based on the motor current pattern; and a course controller configured to determine the clothing treating course according to the clothing material and execute the clothing treating course determined according to the clothing material, wherein the clothing material classifier is configured to apply data related to the motor current pattern to an artificial intelligence model that is trained to classify the clothing material and output information about the clothing material, and wherein the artificial intelligence model comprises a clothing material classifying engine that is trained with learning data to classify and output the clothing material, the learning data including data related to the vibration signal from the vibration sensor, the data related to the motor current pattern, and label data obtained by matching the data related to the motor current pattern to a label of the clothing material.

8. A clothing course control system comprising:

a server; and a clothing treating course control device configured to control a clothing treating course, wherein the clothing treating course control device comprises:

a hanger configured to hang a clothing, a weight sensor configured to sense a weight of the clothing hung on the hanger, a motor configured to vibrate the hanger, a motor current sensor configured to, based on operation of the motor, sense a motor current pattern applied to the motor in accordance with the weight of the clothing, a clothing material classifier configured to classify a clothing material of the clothing based on the motor current pattern, a communicator configured to transmit information about the clothing material to a clothing appliance, and a course controller configured to determine the clothing treating course according to the clothing material and execute the clothing treating course determined according to the clothing material, wherein the server comprises:

an artificial intelligence model learner configured to train a clothing material classifying engine with data related to the motor current pattern through an artificial neural network, wherein the server is configured to transmit the clothing material classifying engine trained through the artificial intelligence model learner to the clothing treating course control device, wherein the clothing material classifier is configured to classify the clothing material of the clothing and to output information about the clothing material of the clothing through the clothing material classifying engine received from the server, and wherein the artificial intelligence model learner is configured to train the clothing material classifying engine with learning data to classify and output the clothing material, the learning data including motor current data related to a plurality of motor current patterns and label data obtained by matching the motor current data to labels of clothing materials.

* * * * *